United States Patent [19]

Osheroff

[11] 3,989,187

[45] Nov. 2, 1976

[54] AIR-CONDITIONING SYSTEM APPARATUS

[75] Inventor: Gene W. Osheroff, Las Vegas, Nev.

[73] Assignee: Fluidtech Corporation, Los Angeles, Calif.

[22] Filed: May 7, 1975

[21] Appl. No.: 575,463

[52] U.S. Cl. ..... 236/13; 137/805; 236/80 D

[51] Int. Cl.[2] ..... F24F 3/00; F24F 13/06

[58] Field of Search ..... 236/49, 13, 80; 137/805

[56] References Cited

UNITED STATES PATENTS

| | | | |
|---|---|---|---|
| 2,815,915 | 12/1957 | Salerno | 236/800 X |
| 3,390,720 | 7/1968 | Meckler | 236/13 X |
| 3,604,625 | 11/1969 | Waeldner | 236/13 |
| 3,680,776 | 8/1972 | Osheroff | 236/80 |
| 3,817,452 | 6/1974 | Dean, Jr. | 236/49 |
| 3,837,571 | 9/1974 | Waeldner et al. | 236/49 |
| 3,883,071 | 5/1975 | Meckler | 236/49 |

*Primary Examiner*—William E. Wayner
*Attorney, Agent, or Firm*—Allen E. Botney

[57] ABSTRACT

The present invention relates to an air-conditioning system that employs fluidic principles to provide temperature control. A fluidic oscillator is utilized to control the conditioning process in which the imput of primary and secondary air to the system is controlled in a push-pull manner so that the supply of primary air increases to the extent the supply of secondary air decreases, and vice versa. Accordingly, the fluidic apparatus regulates the ratio of primary to secondary air directed into the room to be conditioned.

16 Claims, 2 Drawing Figures

AIR-CONDITIONING SYSTEM APPARATUS

Figure 1:
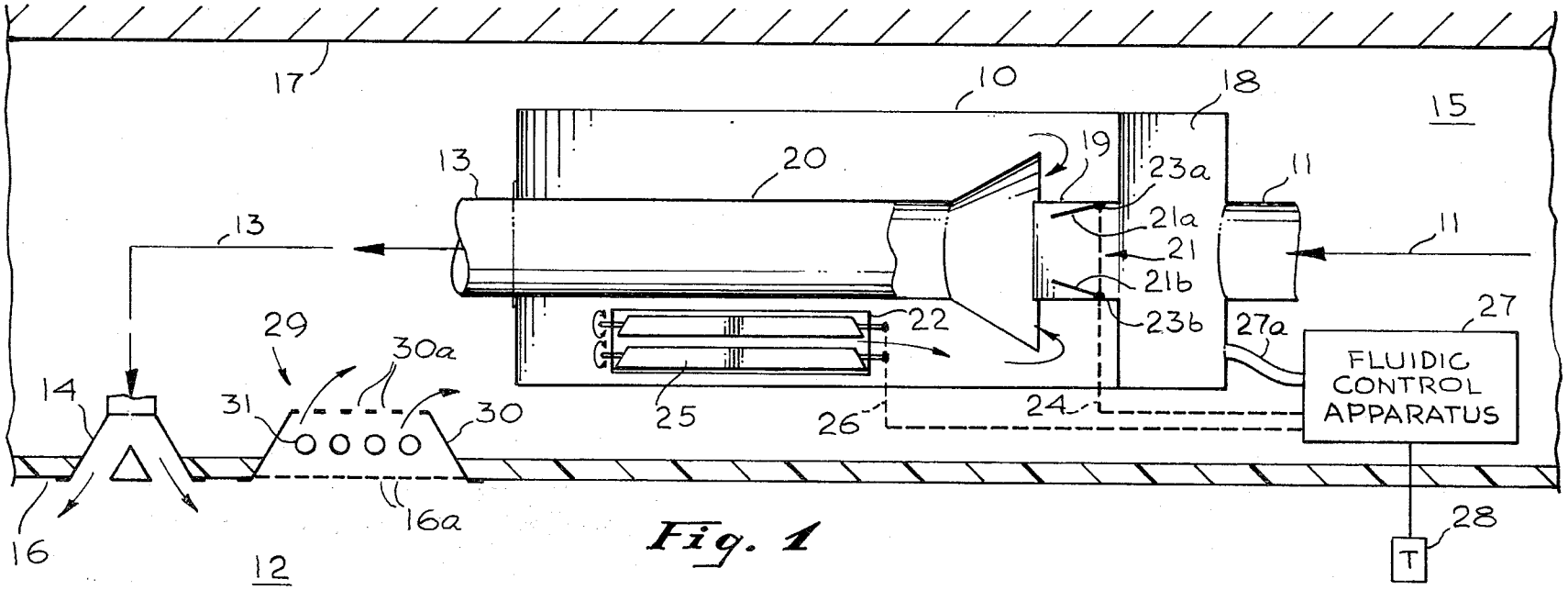

The present invention relates to air-conditioning systems in general and more particularly relates to an air-conditioning system in which fluidic principles are employed to provide temperature control.

In some forms of air-conditioning, the air-conditioning apparatus is mounted in a plenum space provided above the ceiling of the room to be conditioned and operates to provide a continuously varying mixture of conditioned or cooled primary air with warmer secondary air that will bring the room to the desired temperature and accurately maintain it there. In this kind of system, the secondary air is that which is in proximity to the ceiling and which has been warmed by the heat radiated from the several light fixtures in the ceiling as well as the heat generally accumulated near the ceiling. Accordingly, in such systems, the necessity of providing auxiliary heaters for the primary air or other more costly and complex arrangements is eliminated. A good example of this kind of air-conditioning is to be found in the patent granted to Walter W. Kennedy on Dec. 17, 1963, having U.S. Pat. No. 3,114,505.

It is an object of the present invention to provide an air-conditioning system of the aforedescribed kind in which fluidic principles are employed to regulate the ratio of primary to secondary air.

It is another object of the present invention to provide an air-conditioning system of the aforedescribed kind in which the supplies of primary and secondary air are synchronously controlled and operated.

It is a further object of the present invention to provide an air-conditioning system of the aforedescribed kind in which the input of primary and secondary air thereto is controlled in a push-pull manner so that the supply of primary air increases to the extent the supply of secondary air decreases, and vice versa.

It is an additional object of the present invention to provide an air-conditioning system of the aforedescribed kind in which a fluidic oscillator is utilized to control the conditioning process.

The novel features that are believed to be characteristic of the invention, both as to its organization and method of operation, together with further objects as well as advantages thereof, will be better understood from the following description considered in connection with the accompanying drawing in which an embodiment of the invention is illustrated by way of example. It is to be expressly understood, however, that the drawing is for the purpose of illustration and description only and is not intended as a definition of the limits of the invention.

FIG. 1 is a vertical cross-sectional view of the ceiling structure of a room equipped with an air-conditioning system embodying the novel features of the present invention.

Figure 2:
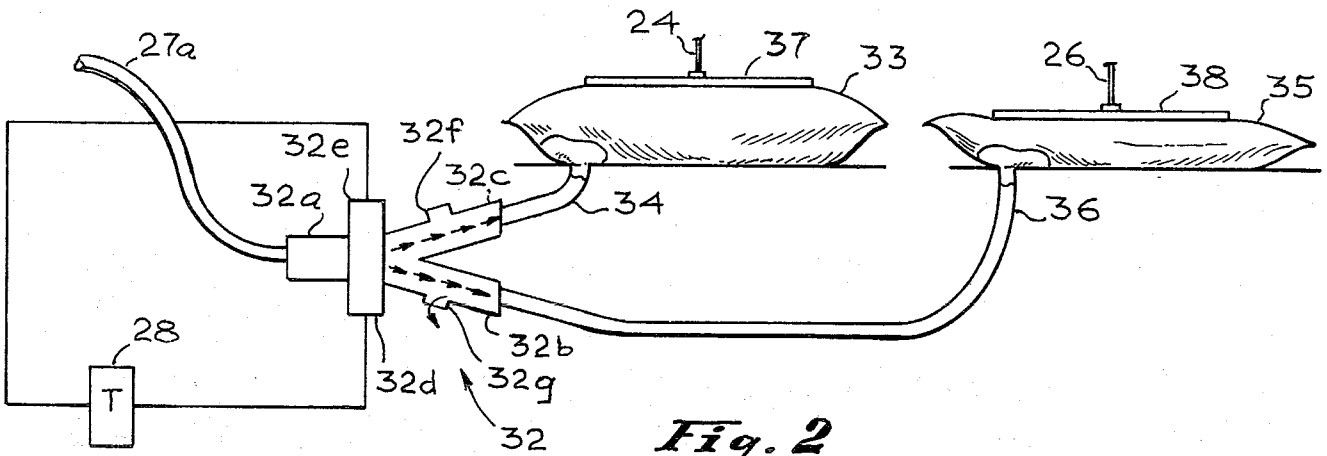

FIG. 2 schematically illustrates the fluidic control apparatus utilized in the FIG. 1 embodiment.

Referring now to FIG. 1 in the drawing, an air-conditioning system according to the present invention includes an apparatus 10 by means of which cool primary air, supplied through an inlet duct 11, is mixed in proper proportions with warm secondary air drawn from the ceiling area of the room to be conditioned, the room being generally designated 12. Thereafter, the mixture is conveyed by the apparatus through an outlet duct 13 to one or more vents 14 for discharge into the room. Apparatus 10 is mounted in a plenum space, generally designated 15, formed by the room's ceiling 16 and a wall 17 spaced above the ceiling.

Apparatus 10 basically includes a chamber 18 that is coupled between inlet duct 11 and a conduit or nozzle structure 19 that faces toward or opens into the throat of a Venturi tube 20. As shown in the figure, the output end of the Venturi tube is coupled to outlet duct 13. Accordingly, the cooled primary air, which is under pressure, enters chamber 18 from which it emerges and is directed by conduit 19 toward and into Venturi tube 20. Apparatus 10 further includes a pair of dampers that operate synchronously, as will be explained below, one damper, generally designed 21, being used to control the flow of the cooled primary air and the second damper, designated 22, being used to control the warm secondary air. Damper 21 is mounted in conduit 19 and includes a pair of damper blades **21*a* and 21*b* that are respectively hinged at hinges 23*a* and 23*b*. Damper blades 21*a* and 21*b* are forced by linkage 24 to operate together, that is to say, to open and close in unison, and it will be recognized by those skilled in the mechanical arts that such linkage is state of the art. By virtue thereof, it was not deemed necessary to include a drawing of any specific linkage. As for damper 22, it is mounted in the wall of apparatus 10 and includes two or more damper blades 25 rotatably mounted therein, the blades being mechanically linked together to also operate in unison. The linkage for damper blades 25 is designated 26** and, as before, is also state of the art apparatus.

An important part of any air-conditioning system according to the present invention is fluidic control apparatus 27 which, as will be explained in greater detail below in connection with FIG. 2, synchronously operates dampers 21 and 22 under the control of a thermovalve 28 located in the room to be conditioned. Stated differently, based on the conditioning needs of room 12 as detected by thermovalve 28, fluidic control apparatus 27 respectively opens and closes dampers 21 and 22, or vice versa, to thereby regulate the mixture of cooled and warm air flowing to the room. Apparatus 27 uses a stream of air as the instrument by means of which it performs its function and, therefore, it employs a tube **27*a* that couples at its mouth end to chamber 18** where it taps off a small portion of the primary air and feeds it to the main body of the fluidic control apparatus.

It should finally be mentioned that FIG. 1 shows a lighting fixture, generally designed 29, that is recessed into ceiling 16, the troffer 30 of the fixture constituting the reflector for lamp bulbs 31. As shown, troffer 30 includes a number of openings **30*a* and ceiling 16 below it includes a number of openings 16*a*, the warm secondary air in the proximity of the ceiling passing through these openings to plenum space 15 where, if damper 22 is open, it flows into apparatus 10 under the aegis of the Venturi effect produced therein to mix with the primary air. As previously mentioned, the ratio of primary to secondary air in the mixture depends on the degree to which the dampers are opened and closed, and this, in turn, it will be remembered, is regulated by fluidic control apparatus 27 under the control of thermovalve 28**.

Referring now to FIG. 2 wherein fluidic control apparatus 27 is presented in greater detail, it is shown to basically comprise a fluidic amplifier arrangement, generally designated 32, and the thermovalve 28. The diagram of the fluidic amplifier arrangement is in schematic form and, therefore, represents any one of a number of fluidic devices that may be used, such as a fluidic oscillator or a bistable fluidic amplifier, but irrespective of the kind of fluidic device used, it will include, as is shown by the schematic, an inlet channel 32*a*, a pair of outlet channels 32*b* and 32*c*, a pair of control channels 32*d* and 32*e*, and a pair of air vents 32*f* and 32*g* respectively located in outlet channels 32*c* and 32*b*. Inlet channel 32*a* is linked or coupled to chamber 18 by means of tube 27*a* and, therefore, as previously stated, a small portion of the air entering chamber 18 is tapped off and fed to inlet channel 32*a*. Finally, outlet channels 32*b* and 32*c* are respectively coupled to a pair of longlife bellows 35 and 33, and on and to the upper walls of these bellows are respectively mounted a pair of plates 38 and 37. The purpose of these plates is to provide a flat, solid surface for each bellows as it expands or contracts or, stated differently, as it inflates and deflates.

As shown in the figure, the rods of linkages 24 and 26 are respectively linked or coupled at one end to dampers 21 and 22, and at the other end to plates 37 and 38. It will be recognized that linkage rods 24 and 26 respectively move up or down as the bellows inflate or deflate to respectively rotate dampers 21 and 22 in clockwise or counterclockwise directions to thereby open or close the dampers. More specifically, as linkage rod 24 moves up in response to the inflation of bellows 33, damper 21 will rotate in one direction or the other and, therefore, will either open or close depending on the manner in which the linkage is coupled to the damper. It will be recognized that if damper 21 closes with the expansion or inflation of bellows 33, then the reverse will be true when the bellows contracts or deflates, namely, the damper will open. On the other hand, if damper 21 opens with the inflation of bellows 33, then it will close with the deflation of the bellows. The operation is the same, of course, as to damper 22, linkage 26 and bellows 35, that is to say, depending on the manner in which linkage rods 26 are coupled to damper 22, damper 22 will either open as bellows 35 inflates (and close as it deflates) or else close as the bellows inflates (and open as it deflates). For sake of clarity and to expedite the description, it will hereinafter be assumed that these elements are coupled in such a manner that the dampers will rotate to a more open position when the bellows inflate and to a more closed position when the bellows deflate.

As is illustrated in the figure, the coupling between outlet channels 32*b* and 32*c* on the one hand and bellows 35 and 33 on the other hand are respectively accomplished by means of hoses 36 and 34, or by means of equivalent devices.

As was previously mentioned, fluidic apparatus 32 may be a fluidic oscillator or a bistable fluid amplifier. Since bistable fluid amplifiers are in common use and, therefore, their construction and operating principles well known by those skilled in the art, no further description of a device of this kind that may be used in the present invention is deemed necessary here. With respect to the fluidic oscillator, however, although the construction and operating principles of these devices are also well known, there are so many different species or variations of them and since it is possible that not all of them may be applicable or adaptable for use herein, it is deemed judicious to identify some specific types of fluidic oscillators as examples of those that can definitely be utilized as the fluidic apparatus in the FIG. 1 embodiment. Towards this end, therefore, reference is made to U.S. Pat. No. 3,680,776 entitled "Fluidic Apparatus for Air-Conditioning Systems", by Gene W. Osheroff, issued Aug. 1, 1972, wherein there is shown and described several species of a fluidic oscillator which, under the control of a thermovalve, operates to deliver pulses of conditioned air of variable duration to its outlet channels. The portions of said patent illustrating and describing said oscillators and their operation are incorporated herein by said reference thereto as though said portions were fully set forth herein. Suffice it to say at this point, therefore, that a steady stream of conditioned air enters these fluidic oscillators, that is to say, the air entering the oscillator is steady state, but the oscillator converts this steady stream of air to pulses of air that are alternately applied by the oscillator to its two outlet channels, the duration of the pulses through these channels being generally different from one another and also varying with the passage of time. More specifically, the duration of the pulses through one or the other of these outlet channels and, therefore, through both of them, is under the control of or, stated differently, regulated by thermovalve 28 which, in turn, means that their duration is a function of the temperature conditions of the room to be conditioned.

As for thermovalve 28, here again any one of a number of different available thermovalves may be used, but one that has already been used in connection with the present invention and found to be suitable for such use is that shown and described in U.S. Pat. No. 3,730,430 entitled "A Thermovalve" by Gene W. Osheroff, issued May 1, 1973. The pertinent illustrative and descriptive portions of said patent are incorporated herein by this reference thereto as though said portions were fully set forth herein. It will be recognized that thermovalve 28 is located in the room to be conditioned and, as is shown in FIG. 2, is coupled to control channels 32*d* and 32*e*. Briefly stated, and as will more fully be explained hereinbelow, the thermovalve directs the fluidic apparatus to either inflate or deflate the bellows so as to match the load conditions of the room.

Considering now the operation of the fluidic control apparatus as thus far described, it will initially be assumed that the thermostat in thermovalve 28 has just been set to the desired room temperature and that a significant difference exists between this temperature and the actual or ambient temperature of the room. For example, it will initially be assumed that the room temperature is a number of degrees higher than the thermostatic setting so that the room needs to be cooled down considerably. Under such conditions, bellows 33 will be almost fully inflated and bellows 35 almost fully deflated, with the result that damper 21 will be almost fully open and damper 22 almost fully closed, thereby permitting a maximum of the cooled primary air to reach the room. In other words, under the conditions assumed, little, if any, of the warm secondary air gets through damper 22 and, consequently, it is primarily the cooled air that is emitted from vent 14 into room 12. Thus, the primary air supplied to the room will be at a maximum.

However, as the room temperature approaches the temperature of the thermostat setting, bellows 33 and 35 will respectively deflate and inflate to increasingly close and open dampers 21 and 22, thereby increasing the amount of secondary air mixing with the primary air. Thus, under the control of fluidic amplifier arrangement 32, damper 22 will gradually open to permit more warm secondary air to get through as the room temperature moves toward the thermostatic setting and, simultaneously and synchronously, damper 21 will gradually close to correspondingly reduce the amount of cooled primary air getting through.

It can be seen, therefore, that the imput of primary and secondary air to the system is controlled in a push-pull manner so that the supply of primary air increases to the extent the supply of secondary air decreases, and vice versa. Accordingly, the fluidic apparatus regulates the ratio of primary to secondary air directed into the room.

It will also be assumed that fluidic apparatus 32 is of the oscillatory type previously identified. Accordingly, the conditioned air entering outlet channels 32*b* and 32*c* is pulsed, with the pulses alternating between the outlet channels to respectively produce two trains of pulses of conditioned air. The duration of the pulses in one train will generally vary with the passage of time and will generally differ from the duration of the pulses in the other train, but since the total amount of air exiting from apparatus 32 must be equal to the amount of air entering it, the duration of the pulses in one outlet channel will become smaller as the duration of the pulses in the other train becomes larger, and vice versa. Thus, the duration of the pulses of conditioned air coming out of outlet channel 32*b* will grow smaller as the duration of the pulses of conditioned air emerging from outlet channel 32*c* grows larger, and vice versa. As previously mentioned, the relative duration of these pulses is a function of the temperature conditions in the room.

With the initial operating conditions as assumed hereinabove, relatively large pulses of air emerge from outlet channel 32*c* and flow into bellows 33 whereas relatively short pulses of air emerge from outlet channel 32*b* and flow into bellows 35. In between the long pulses, that is to say, during the time the air is emerging from outlet channel 32*b*, some portion of the air already in bellows 33 escapes through vent 32*f*. However, the amount of air entering the bellows during each long pulse is far greater than that escaping it between these long pulses, with the result that bellows 33 becomes almost fully inflated and damper 21 is open to about its maximum extent. Bellows 35 is affected in a similar manner in between the short pulses of air thereto, that is to say, during the relatively long periods of time the air emerges from outlet channel 32*c*. During these intervals, the air already in bellows 35 escapes through vent 32*g*, with the result that when bellows 33 is almost fully inflated, bellows 35 is about fully deflated. It also means that when damper 21 is about fully open, damper 22 is almost fully closed, as previously explained.

With conditioned air flowing into the room as described, the temperature of the room gradually approaches the temperature setting of the thermostat and as the difference between these two temperatures decreases, the ratio of cool to warm air flowing into the room correspondingly changes. This is brought about by the fact that as this temperature differential diminishes, the duration of the pulses of conditioned air emerging from outlet channel 32*c* and entering bellows 33 decreases whereas the duration of those emerging from outlet channel 32*b* and entering bellows 35 increases. Accordingly, the overall or net amount of air in bellows 33 decreases as the duration of the pulses of air flowing to it decreases, and the overall or net amount of air in bellows 35 increases as the duration of the pulses of air flowing to it increases. As a result, bellows 33 deflates as the temperature differential decreases and bellows 35 simultaneously and synchronously inflates, thereby gradually closing damper 21 and correspondingly reducing the flow of cool air and, at the same time, gradually opening damper 22 and correspondingly increasing the flow of warm air. Stating it differently, as the conditioning requirement decreases, the thermovalve directs the fluidic oscillator to deflate one bellows and inflate the other one to produce a change in the mixture of cold and warm air flowing to the room.

This process continues until the temperature of the room air substantially equals the temperature setting of the thermostat, at which point the damper positions are such as to substantially maintain the room temperature at the set temperature. Of course, from a purely technical point of view, it will be recognized by those skilled in the art that the system is constantly hunting to exactly match the room load conditions and, therefore, that the damper positions will vary slightly as the system attempts to maintain the room temperature at the thermostat set point.

It will be recognized that if the thermostat in the thermovalve mechanism is reset so that a temperature differential once again exists, the system will revert to the mode of operation previously described and it will continue in said mode until the temperature differential is once again reduced to substantially zero.

Although a particular arrangement of the invention has been illustrated and described above by way of example, it is not intended that the invention be limited thereto. Accordingly, the invention should be considered to include any and all modifications, alterations or equivalent arrangements falling within the scope of the annexed claims.

Having thus described the invention, what is claimed is:

1. An air-conditioning system to which cool primary air and warm secondary air are supplied via respectively different paths, the system providing an appropriate mixtures of the cool and warm air to a room to be conditioned, said system comprising: a first damper mechanism mounted only in the path of the primary air and operable only to control the volume thereof flowing to the room; a second damper mechanism mounted only in the path of the secondary air and operable only to control the volume thereof flowing to the room; a thermovalve mechanism mounted in the room to be conditioned; and fluidic amplifier means coupled to said first and second damper mechanisms, coupled to said thermovalve and coupled to tap off a portion of the primary air flowing to the system, said fluidic amplifier means being operable in response to the flow thereto of said tapped-off portion of primary air and under the control of said thermovalve to simultaneously and synchronously open one of said dampers and close the other of them to provide an appropriate mixture of primary and secondary air to the room, the ratio of primary to secondary air corresponding to the difference between the ambient room temperature and the temperature setting of said thermovalve mechanism.

2. The air-conditioning system defined in claim 1 wherein said fluidic amplifier means includes first and second inflatable devices respectively coupled to said first and second damper mechanisms; and fluid amplifier apparatus coupled between said inflatable devices and said thermovalve mechanism and coupled to receive said tapped-off portion of primary air, said fluid amplifier apparatus being operable under the control of said thermovalve mechanism to simultaneously and synchronously inflate one of said devices and deflate the other of them to respectively open and close the damper mechanisms coupled thereto.

3. The air-conditioning system defined in claim 1 wherein said fluidic amplifier means includes first and second inflatable devices respectively coupled to said first and second damper mechanisms; and fluid amplifier apparatus coupled between said inflatable devices and said thermovalve mechanism and coupled to receive said tapped-off portion of primary air, said fluid amplifier apparatus being operable under the control of said thermovalve mechanism to inflate and deflate said devices in a push-pull manner.

4. The air-conditioning system defined in claim 1 wherein said fluidic means includes first and second inflatable devices respectively coupled to said first and second damper mechanisms; and fluidic oscillator apparatus having an inlet channel coupled to receive said tapped-off primary air, and a pair of outlet channels to which said portion of air flows and which are respectively coupled to said first and second inflatable devices, said pair of outlet channels respectively including a pair of vents through which air in said inflatable devices may respectively be vented, said oscillator apparatus including means to switch the air flowing therein back and forth in an oscillatory manner between said pair of outlet channels to produce pulses of air that are alternately applied to said pair of inflatable devices, the duration of said pulses varying as the difference between said ambient and thermovalve temperatures.

5. The air-conditioning system defined in claim 1 wherein said system further includes a chamber, a Venturi tube mounted within said chamber, a duct for feeding said cool primary air to said Venturi tube, said first damper mechanism being mounted within said duct and said second damper mechanism being mounted in a wall of said chamber, said warm secondary air passing through said second damper mechanism to said chamber.

6. The air-conditioning system defined in claim 1 wherein said fluidic means includes first and second inflatable devices respectively coupled to said first and second damper mechanisms, and fluid amplifier apparatus including a pair of outlet channels respectively coupled to said first and second inflatable devices, said pair of outlet channels respectively including a pair of vents through which air in said inflatable devices may respectively be vented, an inlet channel coupled to receive said tapped-off portion of primary air and through which it flows to said outlet channels, and a pair of control channels through which pressures may respectively be exerted against said tapped-off air to switch the flow thereof between said outlet channels, said control channels being coupled to said thermovalve mechanism which causes said pressures to be applied as a function of the ambient and thermovalve temperature differential.

7. The air-conditioning system defined in claim 3 wherein said system further includes a chamber, a Venturi tube mounted within said chamber, a duct for feeding said cool primary pair to said Venturi tube, said first damper mechanism being mounted within said duct and said second damper mechanism being mounted in a wall of said chamber, said warm secondary air passing through said damper mechanism to said chamber.

8. The air-conditioning system defined in claim 4 wherein said system further includes a chamber, a Venturi tube mounted within said chamber, a duct for feeding said cool primary air to said Venturi tube, said first damper mechanism being mounted within said duct and said second damper mechanism being mounted in a wall of said chamber, said warm secondary air passing through said second damper mechanism to said chamber.

9. The air-conditioning system defined in claim 2 wherein said inflatable devices are bellows.

10. The air-conditioning system defined in claim 4 wherein said first and second inflatable devices include a pair of bellows respectively coupled to said pair of outlet channels, and first and second linkage mechanisms to open and close said first and second damper mechanisms as said bellows inflate and deflate.

11. In an air-conditioning system, the combination of a room within a building having a top wall and a false ceiling spaced therebelow and cooperating therewith to define a plenum space above the room, a plurality of electric lighting fixtures laterally spaced apart across said ceiling and having troffers set into the ceiling and said plenum space and secured to the ceiling and said plenum space and secured to the ceiling, said troffers having lamp bulbs therein lighting said room and heating said troffers so as to heat the air in said plenum space and adajcent said ceiling, an inlet passage through said ceiling establishing communication between the upper part of said room adjacent said ceiling and said plenum space for the upward flow of heated air from the room into such space, an outlet passage extending downwardly through said ceiling for the discharge of conditioned air into said room, said conditioned air being a mixture of said heated air and cool primary air fed to the system, an enclosed structure mounted in said plenum space, a Venturi tube mounted within said structure and coupled at its output end to said outlet passage, a duct for feeding said cool primary air to said Venturi tube, a first damper mechanism mounted in said duct and operable to control only the quantity of cool primary air flowing to said Venturi tube, a second damper mechanism mounted in a wall of said structure and operable to control only the quantity of heated air flowing into said structure from said plenum space, and fluidic amplifier means coupled to said first and second damper mechanisms and simultaneously and synchronously operating them in a push-pull manner to provide a mixture of said cool and heated air at said outlet passage that substantially meets the varying conditioning needs of the room.

12. The combination defined in claim 11 wherein said fluidic amplifier means includes a thermovalve mounted in the room, first and second inflatable devices respectively linked to said first and second damper mechanisms, and fluid amplifier apparatus coupled between said inflatable devices and said thermovalve and coupled to tap off a portion of said cool primary air, said fluid amplifier apparatus being operable under the control of said thermovalve to inflate and deflate said devices in a push-pull manner.

13. The combination defined in claim 12 wherein said inflatable devices are bellows.

14. The combination defined in claim 12 wherein said fluid amplifier apparatus includes a fluidic oscillator having an inlet channel coupled to receive said tapped-off portion of cool primary air, and a pair of outlet channels to which said portion of air flows and which are respectively coupled to said first and second inflatable devices, said pair of outlet channels respectively including a pair of vents through which air in said inflatable devices may respectively be vented, said oscillator including means to switch the air flowing therein back and forth in an oscillatory manner between said pair of outlet channels to produce pulses of air that are alternately applied to said pair of inflatable devices, the duration of said pulses varying as a function of the room and thermovalve temperatures.

15. The combination defined in claim 14 wherein the means in said oscillator includes a pair of control channels through which pressures may respectively be exerted against said portion of tapped-off air to switch the flow thereof between said outlet channels, said control channels being coupled to said thermovalve which includes an element that causes said pressures to be applied as a function of the difference between the ambient temperature of the room and the temperature setting of the thermovalve.

16. The combination defined in claim 15 wherein said inflatable devices are bellows.

* * * * *